US007888582B2

(12) United States Patent
Rechsteiner et al.

(10) Patent No.: US 7,888,582 B2
(45) Date of Patent: Feb. 15, 2011

(54) SOUND SEQUENCES WITH TRANSITIONS AND PLAYLISTS

(75) Inventors: Paul Rechsteiner, Toronto (CA); Ian Epperson, Sunnyvale, CA (US); Lawrence Kesteloot, San Francisco, CA (US); Elliott Pearl, Toronto (CA); Stephen Watson, Toronto (CA); Brian Young, Mountain View, CA (US)

(73) Assignee: Kaleidescape, Inc., Sunnyvale, CA (US)

( * ) Notice: Subject to any disclaimer, the term of this patent is extended or adjusted under 35 U.S.C. 154(b) by 8 days.

(21) Appl. No.: 11/704,165

(22) Filed: Feb. 8, 2007

(65) Prior Publication Data

US 2008/0190267 A1 Aug. 14, 2008

(51) Int. Cl.
*G10H 1/00* (2006.01)

(52) U.S. Cl. ..... 84/633; 84/600; 84/665

(58) Field of Classification Search ..... 84/600–602, 84/633, 665; 700/94; 707/104.1
See application file for complete search history.

(56) References Cited

U.S. PATENT DOCUMENTS 5,919,047 A * 7/1999 Sone ..... 434/307 A
6,316,710 B1 * 11/2001 Lindemann ..... 84/609
6,889,193 B2 * 5/2005 McLean ..... 704/500
6,933,432 B2 * 8/2005 Shteyn et al. ..... 84/609
7,424,117 B2 * 9/2008 Herberger et al. ..... 381/61
2001/0039872 A1 * 11/2001 Cliff ..... 84/609
2002/0172379 A1 * 11/2002 Cliff ..... 381/119
2003/0037664 A1 * 2/2003 Comair et al. ..... 84/609
2003/0110503 A1 * 6/2003 Perkes ..... 725/86
2003/0183064 A1 * 10/2003 Eugene et al. ..... 84/609
2004/0069123 A1 * 4/2004 Becker et al. ..... 84/612
2005/0038819 A1 * 2/2005 Hicken et al. ..... 707/104.1
2006/0000344 A1 * 1/2006 Basu ..... 84/612
2006/0192478 A1 * 8/2006 Basu ..... 313/495
2007/0227337 A1 * 10/2007 Yoshikawa et al. ..... 84/602
2008/0190267 A1 * 8/2008 Rechsteiner et al. ..... 84/609
2008/0215173 A1 * 9/2008 Hicken et al. ..... 700/94
2008/0221895 A1 * 9/2008 Pauws et al. ..... 704/270
2008/0222188 A1 * 9/2008 Watson et al. ..... 707/102

* cited by examiner

*Primary Examiner*—David S. Warren

(57) ABSTRACT

A home theater system includes construction, presentation, and commerce in, songs. Presentation includes at least one of: metadata about songs or sounds, a function capable of transitioning from one song to a next song, and user preferences; and can determine in what manner to transition from one song to a next song. Construction of songs includes either factors above, or at least one of: a function or a user extension capable of selecting a next song, and an element capable of determining whether the song is perceptually random. A user interface is capable of searching playlists and selecting them for presentation, representing each playlist with a substantially unique pictorial representation, distinguishing in presentation between those playlists licensed to the user and those that are not, and capable of substantially immediate purchase of playlist licenses either individually or in bulk and either automatically or with minimal intervention.

41 Claims, 3 Drawing Sheets

SOUND SEQUENCES WITH TRANSITIONS AND PLAYLISTS

BACKGROUND OF THE INVENTION

A first known issue in playing songs, whether from a radio broadcaster or at an informal gathering, is making a transition from the end of one song to the beginning of the next. Listeners desire transitions that sound natural, while songs (and other sounds) have a wide variety of beginnings and endings, at least some of which are important to presentation of the song.

A second known issue in playing songs is that of ordering a set of songs for presentation, or alternatively, of selecting a next song for presentation when one song ends. After any particular song, listeners remain relatively uninformed about which song would be best that they should play next. One known method is for a person to prepare a song sequence, sometimes known as a "playlist", ahead of time, exercising their human judgment about which songs should follow which. This method has the first drawback that it can be time consuming, and the second drawback that it might take substantial originality to prepare a playlist that is pleasing to listeners.

SUMMARY OF THE INVENTION

The invention includes techniques for constructing and presenting sound sequences, and for commerce in those sequences.

Presentation includes determining—in response to metadata about those songs, sources of those songs, two functions of pairs of songs (in a preferred embodiment, these two functions operate to form relationships between song metadata and types of transitions), and a set of user preferences—in what manner to transition from one song to a next song. Where appropriate, this aspect also includes performing the transition. As described below, a transition between songs includes any activity near the end of a first song and near the beginning of a second song, including altering a digital encoding of the coded audio signal representing those songs.

After reading this application, those skilled in the art would recognize that the first function and the second function perform distinct useful functions, as described below. The first function operates to determine whether or not to conduct a transition between songs, that is, the first function includes a "whether-to" function, while the second function operates to determine a method of conducting a transition between songs, that is, the second function includes a "how-to" function, for transitions.

Construction includes—in response to the same or similar factors—determining a playlist likely to be pleasing to listeners. Construction of the playlist, as exemplified by the selection of which songs to include and where to place those songs in the playlist order, can also be responsive to a set of sources of those songs, responsive to metadata about those songs, responsive to one or more user preferences about those songs and possible transitions, responsive to whether listeners will perceive the playlist as substantially without human-perceivable pattern, and responsive to whether adjacent songs would be perceived by listeners as having relatively pleasing transitions.

Presentation also includes—having constructed a playlist or obtained one from a person who created a playlist—providing a user interface by which listeners can select playlists for presentation, searching playlists in response to metadata and user requests about those playlists, and selling licenses to those playlists to listeners.

Commerce includes providing an automatic or partially automatic technique for listeners to buy those licenses, either individually or in bulk.

PREFERRED EMBODIMENTS

The invention is further described below with respect to preferred embodiments. No admission is made that these preferred embodiments are the only possible embodiments, or even the majority of embodiments, of the invention.

These techniques can be performed using a presentation system with access to a database of metadata about those songs and sources of those songs, and with ability to compute transition functions between songs, and with ability to receive or deduce user preferences for song transitions. In a preferred embodiment, metadata obtained from that database, whether cached or dynamically accessed, plays a substantial role in determining methods for transitioning between adjacent songs in a playlist, or modifying a song at the beginning or end of the playlist. In this context, the substantial role performed by that metadata is consistent with a model of using an external database of useful information to influence local behavior of home theaters and related devices. In a preferred embodiment, these techniques can be performed using a home theater system, in which the presentation system controls substantially all equipment associated with presentation; the system is responsive to a sequence of songs to be presented, and the system controls the presentation equipment to conduct transitions as it so determines.

In preferred embodiments, the system—which might be a functional component of a presentation system or another system—has access to a database of metadata about those songs and user rights associated with those songs (whether the same database as for presentation, or otherwise), has ability to determine transitions between songs (whether the same transitions as for presentation, or otherwise), and has ability to determine a degree of whether listeners will perceive the playlist as substantially without pattern. The latter is sometimes referred to herein as perceptually random, as distinct from statistically random.

In preferred embodiments, the system provides a user interface such as those described in the incorporated disclosure; in particular, the system can represent each playlist as an object in the mosaic-like user interface, such as for example the user interface described in [KAL 18], with similar playlists (according to some metric) being placed relatively closer than less-similar playlists. A pictorial representation of a song might preferably include a cover of an anthology or CD embodying that playlist, a representation of the genre or singers associated with that playlist, or a picture of a celebrity associated with that playlist. For example, the latter might show a flattering photograph of Professor Watson to represent a playlist titled "Professor Watson's duets for coffee cups and donuts".

In preferred embodiments, the user interface, whether mosaic-like or otherwise, provides for selecting a playlist for presentation, and for searching those playlists available to the system in response to metadata about those playlists. The user interface also preferably distinguishes those playlists licensed to the user from those that are not, allows the user to select a collection of playlists for purchase, either individually or in bulk, and allows the user to order playlists automatically or with minimal intervention.

GENERALITY OF THE DESCRIPTION

Figure 1:
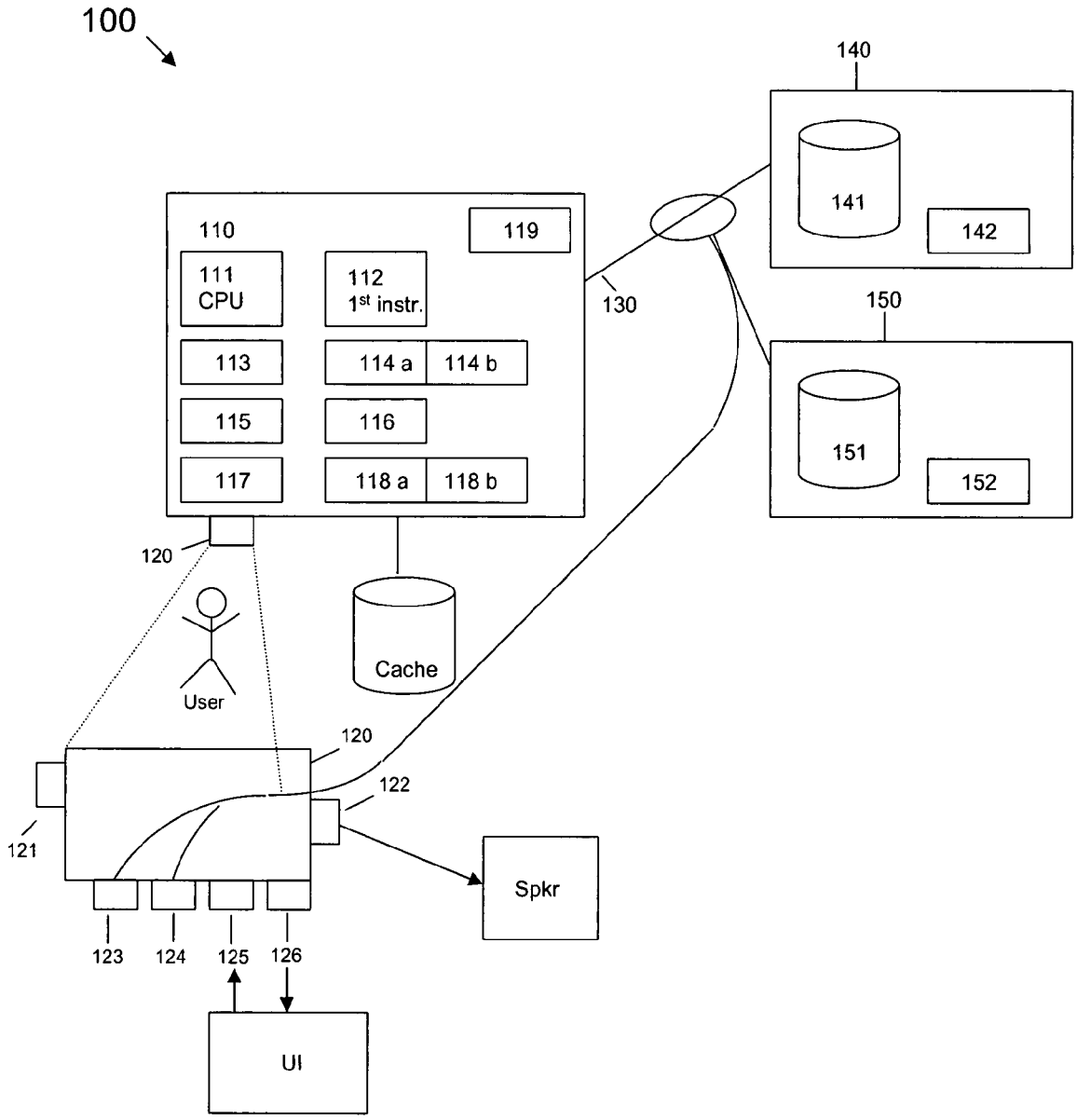
FIG. 1 shows a block diagram of a system capable of constructing and presenting sound sequences.

This application should be read in the most general possible form. This includes, without limitation, the following:

References to specific structures or techniques include alternative and more general structures or techniques, especially when discussing aspects of the invention, or how the invention might be made or used.

References to "preferred" structures or techniques generally mean that the inventor(s) contemplate using those structures or techniques, and think they are best for the intended application. This does not exclude other structures or techniques for the invention, and does not mean that the preferred structures or techniques would necessarily be preferred in all circumstances.

References to first contemplated causes and effects for some implementations do not preclude other causes or effects that might occur in other implementations, even if completely contrary, where circumstances would indicate that the first contemplated causes and effects would not be as determinative of the structures or techniques to be selected for actual use.

References to first reasons for using particular structures or techniques do not preclude other reasons or other structures or techniques, even if completely contrary, where circumstances would indicate that the first reasons and structures or techniques are not as compelling. In general, the invention includes those other reasons or other structures or techniques, especially where circumstances indicate they would achieve the same effect or purpose as the first reasons or structures or techniques.

After reading this application, those skilled in the art would see the generality of this description.

DEFINITIONS

The general meaning of each of these following terms is intended to be illustrative and in no way limiting.

The term "song", and the like, is broadly intended to encompass any combination of media capable of being presented by the system, whether specifically audible, visible, both, or otherwise. This might include one or more of, or some combination of, the following:

music (regardless of genre or performer, including any song, lyrics, or instrumental recorded commercially or otherwise);

sound effects, such as for example and without limitation background sound-effects noises (crowds to simulate attendance at a sports event, office equipment to simulate a work environment for those with home offices, and the like), including the possibility of incorporated lighting effects and other effects not purely sound-related, such as to have a positive effect on work productivity;

bedtime or story-related noises for children (lullabies, spooky ghost story noises, sound effects for stories to read to small children, and the like), including the possibility of incorporated lighting effects and other effects for added entertainment value; and weather noises (thunder and lightning, wind and rain, and the like), including the possibility of incorporated lighting effects and other effects for added entertainment value;

comedy routines, monologues, speeches, sound tracks from movies, and the like;

lighting changes (sunrises, sunsets, raising the level of light to compensate for dusk or to simulate sunrise as a form of alarm clock, "disco music" dancing lights, and the like), alone or in combination with any other ambient effect capable of being presented by the system, such as for example and without limitation (1) raising the house lights when a playlist is complete, (2) flashing the house lights to indicate an interruption or pause of the playlist, such as for example due to a visitor at the door, and the like.

The phrase "sound sequence", and the like, generally describes any and all types of sound as described by the term "song", and the like, as well as any and all types of audiovisual or sensory changes that might be used as transitions between songs, or as transitions between a song and a beginning or end of a playlist.

The term "playlist", and the like, generally describes any and all sequences of songs, whether or not including those sound sequences used as transitions between songs, or as transitions between a song and a beginning or end of the playlist.

The term "transition", and the like, generally describes any and all sequences of effects, whether or not audible, visible, or both or neither, generally starting from near or at the end of one song and ending near or at the beginning of a following song. In a preferred embodiment, a transition might also exist between a song and a beginning or an end of a playlist. For example, a transition might involve mixing at least part of the sources of adjacent songs, or a song and a canonical set of data associated of an end of a playlist, to produce a sound sequence intended to be pleasing to a listener. In a preferred embodiment, a transition might also explicitly alter some aspects of a song, such as for example pitch, tempo, volume, and the like. A transition might also be known as a sound effect, a cross-fade, a fade-in, a fade-out, and the like.

The term "user", and the like, is generally described by example with reference to FIG. 1, such as for example, a user of the system described in FIG. 1.

The scope and spirit of the invention is not limited to any of these definitions, or to specific examples mentioned therein, but is intended to include the most general concepts embodied by these and other terms.

System Elements

FIG. 1 shows a block diagram of a system capable of constructing and presenting sound sequences.

A system 100 includes elements shown in the figure, including at least the following:

| | |
|---|---|
| A computing device 110 | A set of input/output elements 120 |
| A communication link 130 | A first database 140 |
| A second database 150 | |

In a preferred embodiment, a major physical portion of the system 100 would be located in, or coupled to, a home theater or other home entertainment system. This would include at least the computing device 110, the input/output elements number 120, and at least part of the communication link number 130.

The first database 140 and the second database 150 would be located external to the home entertainment system, such as for example at a server location at which the first database 140 and the second database 150 are maintained. However, the system number 100 might cache significant portions of the first database 140 or the second database 150, for relative ease, reliability, speed, or other reasons. In an alternative embodiment, each of the first database 140 or the second database 150 can be an amalgamation of several databases from different sources with similar types of information.

As described herein, the "user" of the system 100 typically refers to an individual person, or a set of persons, with access to a set of user controls for manipulating a user interface associated with the system 100. However, in alternative embodiments, a "user" of the system 100 might refer to a controlling program, such as a programmable timer system or a remote device (for when the user wishes to control the system on the way home from work), or might even refer to an Artificial Intelligence program or another substitute for actual human control.

The computing device 110 includes elements shown in the figure, including at least the following:

| | |
|---|---|
| A computing element 111 - including processor, memory, and mass storage 111 | A first set of instructions 112 - relating to constructing and presenting sound sequences |
| A first record 113 - of first transition functions $fn_1(s_1, s_2)$ | A second set of instructions - relating to (114a) accessing the first database 140, and (114b) determining whether to perform a transition, responsive to information in the first database 140 |
| A second record 115 - of express user preferences (and associated instructions, not shown in the figure) | A third set of instructions 116 - relating to determining how to transition sound sequences |
| A third record 117 - of second transition functions $fn_2(s_1, s_2)$ | A fourth set of instructions - relating to (118a) accessing the second database 150 (118b) determining what transition to perform, responsive to information in the second database 150 |
| A fourth record 119 - of deduced user preferences, and instructions relating to deducing those user preferences | |

The computing element 111 includes a processor, memory, and mass storage, configured as in a known desktop, laptop, or server device. In a preferred embodiment, the mass storage includes both attached mass storage, such as a hard disk drive, and detachable mass storage, such as an optical disc reader for CD, DVD, HD DVD, or Blu-ray type discs. However, in the context of the invention, there is no particular requirement that the computing element 111 include those elements, so long as the computing element 111 is capable of performing the maintaining its state as described herein, and performing the method steps described herein. For a first example, there is no particular requirement that the computing element 111 include mass storage, although the inventors expect that a preferred embodiment will include mass storage. (At least currently, songs are commonly encoded as relatively large digital files representing those media, while the computing device 110 is expected to have direct access to those digital files.) For a second example, there is no particular requirement that the computing element 111 is structured as a deterministic device—nondeterministic devices, such as including parallel processing devices, would work as well.

The first set of instructions 112 are interpretable by the computing element 111, and relate to constructing and presenting sound sequences. In a preferred embodiment, the computing element 111 is coupled to hardware devices for presenting sound sequences, such as speakers and other home theater equipment. This has the effect that the computing element 111, upon interpreting the first set of instructions 112, can construct and present the sound sequences in a form capable of being received by users. In some embodiments, the first set of instructions 112 might include actual audio or video data for direct presentation to the user.

To Transition, or Not to Transition, that is the Question

The first record 113 includes information describing a first set of transition functions $fn_1(s_1, s_2)$, each of which describes whether there should be a transition, sometimes referred to herein as a "cross-fade", between its corresponding pair of sound sequences. In a preferred embodiment, the transition functions in this first set are responsive to metadata about the songs, such as for example their genre, whether they appear on the same CD-ROM or DVD formatted medium, whether the song has a beginning or ending that already accounts for a transition (such as for example an slow increase in volume at a beginning of the song or a slow decrease in volume at the end of the song), and the like. In a preferred embodiment, the transition functions in this first set are Boolean and describe at least the following behavior:

| Sound Sequence Information | Transition? |
|---|---|
| either $s_1$ or $s_2$ includes classical music | $fn_1(s_1, s_2)$ = FALSE |
| both $s_1$ and $s_2$ include disco music | $fn_1(s_1, s_2)$ = TRUE |
| $s_1$ includes a fade-out sequence | $fn_1(s_1, s_2)$ = FALSE |
| $s_2$ includes a fade-in sequence | $fn_1(s_1, s_2)$ = FALSE |
| $s_1$ and $s_2$ are the same song | $fn_1(s_1, s_2)$ = FALSE |
| $s_1$ includes funk music and $s_2$ includes soul music | $fn_1(s_1, s_2)$ = TRUE, an example of dissimilar genres |
| $s_1$ includes bluegrass music and $s_2$ includes bebop music | $fn_1(s_1, s_2)$ = FALSE, an example of similar sub-genres |

The second set of instructions (114*a* and 114*b*) are interpretable by the computing element 111, and are capable of directing the computing element 111 to access the first database 140. In a preferred embodiment, the first database 140 includes information regarding each sound sequence, and regarding each pair of sound sequences, suitable to provide the computing element 111 with the ability to determine whether there is a reason—in addition to, in combination with, or instead of, the information in the record 113 of first transition functions $fn_1(s_1, s_2)$—for a particular decision regarding whether to cross-fade between the sound sequences.

For one example, the first database 140 might include at least information regarding whether to make a song transition between songs, such as responsive to information about pairs of those songs, including their artist, genre, title, track recording, and the like. Thus, the first database 140 might indicate that a sequence of two classical music songs should not have an induced transition other than a brief silent gap. After reading this application, those skilled in the art will recognize that the first database 140 includes at least some of the body of knowledge about songs that experts, such as DJs, use to determine whether or not to perform song transitions. This type of information is not generally easy to collect, or to learn, and is thus believed to be a valuable addition to the functional capabilities of the system.

The instructions 114*b*, responsive to metadata relating to songs, apply that metadata as input to the first transition functions $fn_1(s_1, s_2)$. For example, information in the first database 140 might describe that a particular first song $s_1$ and a particular second song $s_2$ follow consecutively on a commercially-available CD. For another example, information in the first database 140 might describe that a pair of songs are the first and last tracks in pair of consecutive discs in a commercially-available boxed set of discs. This has the effect that the instructions 114*b*, in conjunction with information from the first database 140, direct the computing element 111 to determine whether or not to perform a transition between the particular first song $s_1$ and a particular second song $s_2$. A first possibility is that the computing element 111 might determine to perform the transition; a second possibility is that the computing element 111 might determine not to perform the transition.

The second record 115 (along with associated instructions) includes information regarding express user preferences for transitions. (In a preferred embodiment, the information in the second record 115 is interpretable by the computing element 111 under the direction of those instructions for parsing that second record 115.) This has the effect that the user might suppress transitions entirely, force transitions in cases where the first transition functions or the first database 140 would indicate otherwise, or indicate other preferences regarding transitions. For one example, the user might specify that the computing element 111 should perform transitions at the default, in all cases where transitions are not explicitly prohibited by the first transition functions or the first database 140.

Two Songs, Transitioned in Another Way, Would not Sound as Sweet

The third set of instructions 116 are interpretable by the computing element 111, and are capable of directing the computing element 111 how to transition 21 sound sequences. In a preferred embodiment, the computing element 111 is capable of using the third set of instructions 116 in addition to, in combination with, or instead of, the first set of instructions 112. This has the effect that the computing element 111, upon interpreting the third set of instructions 116, can construct and present the sound sequences in a transitioned form, with users being capable of receiving that transitioned form.

The third record 117 includes information relating to second transition functions $fn_2(s_1, s_2)$, each of which describes how to transition, e.g., cross-fade, between its corresponding pair of sound sequences. Similarly to the first transition functions $fn_1(s_1, s_2)$, the second transition functions $fn_2(s_1, s_2)$, are responsive to metadata about the songs $s_1$ and $s_2$, such as for example their author, genre, title, or track location. This has the effect that, as described herein, the first transition functions $fn_1(s_1, s_2)$ have the effect of determining whether or not to perform a song transition, while the second transition functions $fn_2(s_1, s_2)$, once it is determined that a song transition will be performed, have the effect of determining how to perform that song transition.

In one example, first transition functions $fn_1(s_1, s_2)$, applied to songs that are both classical music, might provide a result indicative of "no transition", that is (roughly speaking), $fn_1$(classical, classical)=FALSE, while first transition functions $fn_1(s_1, s_2)$, applied to songs that are both disco music, might provide a result indicative of "yes transition", that is (roughly speaking), $fn_1$(disco, disco)=TRUE.

In this example, once the first transition functions $fn_1(s_1, s_2)$, applied to songs that are both classical music, indicate $fn_1$(classical, classical)=FALSE, the second transition functions $fn_2(s_1, s_2)$ need not specify how to perform a transition, because it is determined not to perform one. In contrast, once the first transition functions $fn_1(s_1, s_2)$, applied to songs that are both disco music, indicate $fn_1$(disco, disco)=TRUE, the second transition functions $fn_2(s_1, s_2)$ do specify how to perform that transition, using values obtained from $fn_2$(disco, disco). For example, $fn_2$(disco, disco) might indicate that the transition from one disco song to another will include a symmetric six-second cross-fade of the two songs.

In a preferred embodiment, the second transition functions $fn_2(s_1, s_2)$, describe at least the following behavior:

| Sound Sequence Information | Action |
|---|---|
| either $s_1$ or $s_2$ includes classical music | $fn_2(s_1, s_2)$ includes the default classical transition (such as for example a brief silence, possibly zero duration) |
| $s_1$ ends with spoken words or $s_2$ begins with spoken words | $fn_2(s_1, s_2)$ does not include a fade-out of $s_1$ |
| $s_1$ and $s_2$ both include disco music | $fn_2(s_1, s_2)$ includes a six second symmetrical linear cross-fade of $s_1$ and $s_2$ |
| $s_1$ and $s_2$ both include rock music | $fn_2(s_1, s_2)$ includes a fade-out of the $s_1$ for 4 seconds, followed by playing the beginning of $s_2$ at full volume |

In a preferred embodiment, when a transition includes cross-fading two songs, the volume of the transition should not exceed the maximum amplitude of each song.

In a preferred embodiment, if a song that includes audience noise from a live recording then a transition for that song may include fading-out or fading-in that audience noise. If a song includes studio silence from a studio recording then a transition for that song may include preserving that silence.

In a preferred embodiment, even when transitions that do not include a cross-fade (that is, mixing the audio elements of the songs), those transitions might still include insertion or addition of other audiovisual effects. These audiovisual effects might include, for example, at least one of the following:

- Brief silence, possibly so brief as to be human-perceivable as being zero duration.
- A predetermined sound sequence, such as one or more of, or some combination of, the following:
  - A brief tone sequence, such as a doorbell, gong, or telephone ring-tone;
  - A brief voice sequence, such as a voiceover announcing a new sound sequence, which might itself include a description or name of the new sound sequence;
  - A brief sound sequence associated by the user with a transition from a first sound sequence to a second sound sequence, such as one or more of, or some combination of, the following: a dog barking, a loud click, a record scratching sound, a set of "funky static" or other radio static-like sounds, a siren, a zipper sound, and the like;
  - A set of lighting changes, either as described above, or such as a set of flashes to indicate a transition.
  - A sound sequence describing the next or previous song, such as an audio clip announcing the song title. This can be a commercially licensed or purchased clip, such as library of clips from a known radio personality (e.g., Wolfman Jack), or a computer-generated vocalization.

In a preferred embodiment, the first database 140 and the second database 150 include information sufficient to direct the computing element 111 to perform (or direct) the actions described above.

The fourth set of instructions (118*a* and 118*b*) are interpretable by the computing element 111, and are capable of directing the computing element 111 how to access the second database 150. In a preferred embodiment, the second database 150 includes information regarding each pair of sound sequences, suitable to provide the computing element 111, upon interpreting the fourth set of instructions 118, with the ability to determine how to perform—in addition to, in combination with, or instead of, the second transition functions $fn_2(s_1, s_2)$—a particular transition between the sound sequences.

In a preferred embodiment, for example, the second database 150 includes sufficient information for the computing element 111 to construct (or lookup) a transition between songs. In a preferred embodiment, the second database 150 might include the examples of second transition functions $fn_2(s_1, s_2)$, described above.

For one example, the second database 150 might include at least information regarding what transitions to make between songs, such as responsive to information about pairs of those songs, including their artist, genre, title, track numbering (as found for example on CD-ROMs and DVDs), track recording, and the like. Thus, the second database 150 might indicate that a sequence of two steel drum band songs should have an induced transition which is an overlap of a muted end of the first song with a muted beginning of the second song, while it might also indicate that a sequence of two disco songs should have an induced transition including a volume fade-out of a first song and a volume fade-in of a second song.

After reading this application, those skilled in the art will recognize that the second database 150 includes at least some of the body of knowledge about songs that experts, such as filtering and mixing engineers, use to determine how to perform song transitions. This type of information is not generally easy to collect, to learn, or to apply by an automated system, and is thus believed to be a valuable addition to the functional capabilities of the system.

The instructions 118, responsive to metadata relating to songs, apply that metadata as input to the second transition functions $fn_2(s_1, s_2)$. For example, information in the second database 150 might describe that a particular first song $s_1$ and a particular second song $s_2$ match well (that is, are pleasing to listeners) when that first song $s_1$ precedes that second song $s_2$. This has the effect that the instructions 118, in conjunction with information from the second database 150, direct the computing element 111 to perform a transition between the particular first song $s_1$ and a particular second song $s_2$. There are many types of possible transition types that might be selected in response to information about the particular first song $s_1$ and the particular second song $s_2$.

The fourth record 119 includes information regarding deduced user preferences for cross-fade, and a set of instructions interpretable by the computing device 110 for deducing those user preferences. (In a preferred embodiment, the information in the fourth record 119 is interpretable by the computing element 111 under the direction of a set of instructions for parsing that fourth record 119.) Possible deduced user preferences include one or more of, or some combination of, the following:

A set of transitions associated with particular emotions for sound sequences, e.g., downbeat, upbeat, and the like.

A set of transitions associated with particular genres for sound sequences, e.g., ballads, classical, country and western, hip-hop or rap, jazz, rhythm and blues, rock or "alternative rock", and the like.

A set of transitions associated with particular groups or singers for sound sequences.

A set of transitions associated with particular instruments used in sound sequences, e.g., horns, percussion, strings, woodwinds, and the like.

In a preferred embodiment, user preferences might be determined in one or more of several ways:

(explicitly) The user specifically states a set of preferences, such as for example by entering those preferences directly into memory of the system 100 (or its computing device 110), such as by using a user interface. For example the user might specify a particular sound and lighting change to be applied at each transition, or at transitions meeting conditions described by the user.

(implicitly) The user might change the state of the system 100 (or its computing device 110), such as by using a user interface. For example, the user might direct the system 100 to enter a fast-forward mode, or a sound-muted mode, in which the system 100 determines by default that selected aspects of transitions are altered. In a preferred embodiment, in this particular example, the system 100 might mute, either partially or entirely, all audio effects made during transitions, while retaining selected visual effects (such as lighting changes) made during transitions.

(deduced preferences) The system 100 might deduce preferences in response to demographic information about the user, in response to one or more behaviors by the user.

Demographic information about the user might include information explicitly entered by the user, or by the manufacturer or seller of the system 100, such as the user's age, marital status, income, community (possibly as exemplified by the user's zip code or other postal code), or by the number and types of devices coupled to the system 100 for its information and control. In a first particular example, the system might deduce demographic information about the user by the number of presentation locations throughout the home system, the number of distinct parental control settings, or the relative expense of the system 100 itself, and the like. In a second particular example, the system might deduce demographic information about the user by the number and type of songs the user owns.

Behaviors by the user might include information such as those songs played more commonly by the user, those songs that the user allows to play to completion versus those songs that the user interrupts in favor of different songs, aggregate information about those songs, such as a measure of their concentration in particular genres or singers, or a measure of dispersion of those songs across particular times when written or recorded, a measure of correlation between the user's song preferences and a time of day or a measure of local weather, and the like.

In attempting to deduce information with respect to user preferences, the system might respond to metadata about those songs, such as for example author, dates written or recorded, genre, singer, and the like. The system might in addition or instead respond to direct information about those songs, such as for example the beat, number of voices, pitch, tempo, volume, and the like.

In attempting to deduce information with respect to user preferences, the system might request additional metadata from the user regarding those songs, such as by asking the user "why did you like that song?", "why did you cut that song off in the middle", "if you like this song, do you like other songs by the same singer?", and the like. To the extent that the user supplies that additional metadata, the system can exercise deductive techniques, as described below, to better determine the user's preferences.

In a preferred embodiment, the computing device 110 makes these deductions under control of instructions interpretable to perform machine learning. Possible machine learning techniques for deducing user preferences include one or more of, or some combination of, the following:

Analysis of waveforms or wavelets in particular sound sequences selected by the user.

Analysis of statistical patterns in particular features of sound sequences selected by the user.

Application of an expert system of deduction rules relating to particular features of sound sequences selected by the user.

Analysis of the history of transitions already determined for song sequences selected by the user, including the case of a (partially constructed) playlist.

Heuristic analysis of pairs of songs with incomplete metadata on transitions to similar pair songs with more metadata on transitions.

More-Passive Elements

The input/output elements 120 include elements shown in the figure, including at least the following:

| | |
|---|---|
| A sound sequence input 121 | A sound sequence output 122 |
| A message input 123 | A message output 124 |
| A user command input 125 | A user interface output 126 |

In a preferred embodiment, the sound sequence input 121 might include a reader for any particular physical medium on which sound sequences can be stored, such as CD-ROM, DVD, or a set of memory or mass storage (e.g., in the latter case, hard disk drives). In alternative embodiments, the sound sequence input 121 may in addition or instead include a receiver for any particular communication of sound sequences, such as a radio, television, or computer network input. In the context of the invention, there is no particular requirement for any individual choice of physical devices for the sound sequence input 121, so long as the computing device 110 is capable of maintaining the information, and performing the methods, as described herein, with respect to those sound sequences. As noted above, in a preferred embodiment, the sound sequence input 121 might be included in a home theater or home entertainment system.

In a preferred embodiment, a home theater or home entertainment system includes the sound sequence output 122. In the context of the invention, there is no particular requirement for the physical construction of the sound sequence output 122, so long as the computing device 110 is capable of presenting sound sequences to the user.

The message input 123 is coupled to the communication link 130 and to the computing device 110, and is capable of receiving messages on behalf of the computing device 110. As described herein, messages might be received on behalf of the computing device 110 from either the first database 140 or the second database 150, from an external source of a sound sequence or a license to a sound sequence, and the like.

Similarly, the message output 124 is coupled to the communication link 130 and to the computing device 110, and is capable of sending messages on behalf of the computing device 110. As described herein, messages might be sent on behalf of the computing device 110 to either the first database 140 or the second database 150 (e.g., as part of a request for information), to an external source of a sound sequence or a license to a sound sequence (e.g., as part of a commercial transaction regarding that sound sequence), and the like.

Similar to the message input 123, the user command input 125 is coupled to a user interface and the computing device 110, and is capable of receiving messages from the user on behalf of the computing device 110.

Similar to the message output 124, the user command output 126 is coupled to a user interface and the computing device 110, and is capable of sending messages to the user on behalf of the computing device 110, e.g., as part of a user interface.

The communication link 130 is coupled to the message input 123 and the message output 124, at a first end, and to an external communication network, such as the Internet, at a second end. In a preferred embodiment, the communication link 130 transfers messages between the computing device 110 and any external devices, including the first database 140 and the second database 150, with which the computing device 110 communicates.

The first database 140 includes mass storage 141 including at least the information described herein, organized so as to be retrievable by a set of database requests, and a server 142 capable of receiving and responding to database requests for information from that mass storage 141.

Similarly, the second database 150 includes mass storage 151 including at least the information described herein, organized so as to be retrievable by a set of database requests, and a server 152 capable of receiving and responding to database requests for information from that mass storage 151.

Methods of Operation I: Cross-Fading

Figure 2A:
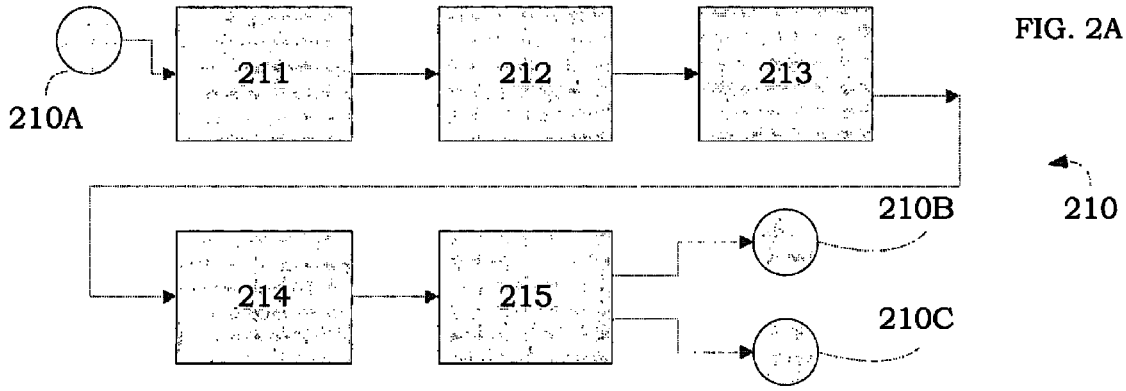
FIG. 2 (collectively including FIG. 2A, FIG. 2B, and FIG. 2C) shows a set of process flow diagrams of methods relating to cross-fading, used with a system capable of constructing and presenting sound sequences.
Figure 2B:
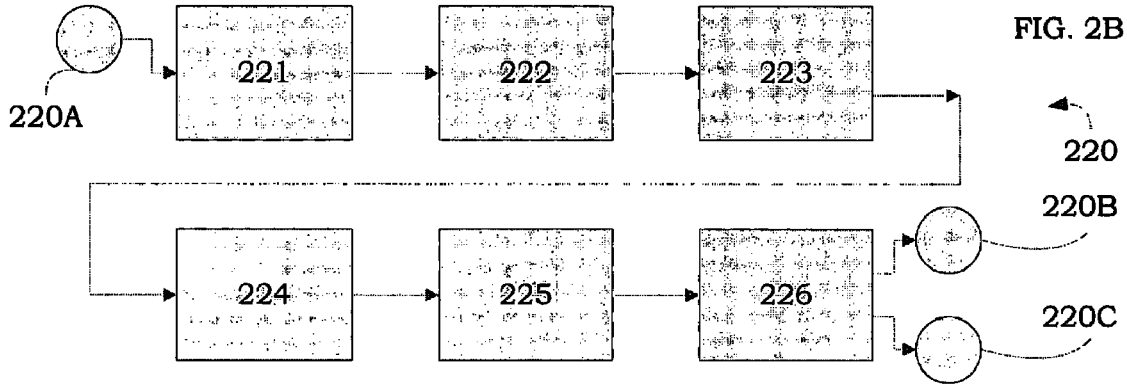
Figure 2C:
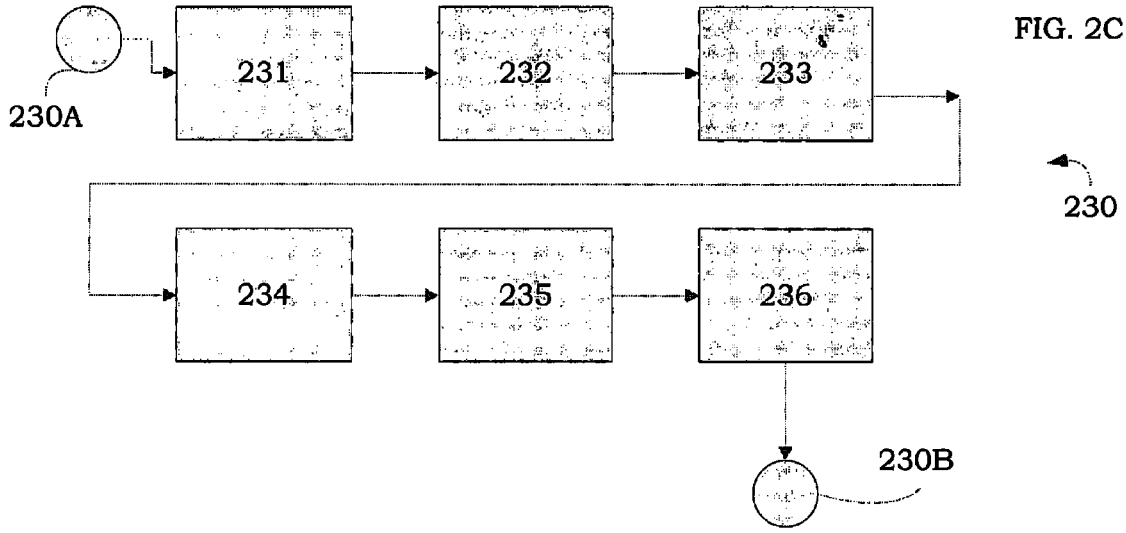

FIG. 2 (collectively including FIG. 2A, FIG. 2B, and FIG. 2C) shows a process flow diagram of methods relating to cross-fading, used with a system capable of constructing and presenting songs.

Cross-Fading I

FIG. 2A shows a process flow diagram of a method of determining whether to cross-fade in response to a song and metadata about that song.

A method 210 of determining whether to cross-fade in response to a song and metadata about that song includes flow points and steps shown in the figure, including at least the following:

| | |
|---|---|
| A flow point 210A, defining a beginning of the method 210. | A step 211, at which a first song is received. |
| A step 212, at which the first song is presented. | A step 213, at which an end of the first song is noted. |
| A step 214, at which metadata is determined relating to the first song. | A step 215, at which it is concluded whether or not to cross-fade. |
| A flow point 210B, at which the method 210 continues to the method 230. | A flow point 210C, defining an ending of the method 210. |

At a flow point 210A, a beginning of the method 210 is defined.

At a step 211, a first song is received by the computing device 110.

At a step 212, the first song is presented to the user by the computing device 110.

At a step 213, an end of the first song is noted by the computing device 110. In a preferred embodiment, this step 213 is performed substantially simultaneously with the previous step, and in any event, substantially before the end of the first song is required to be presented to the user.

At a step 214, the computing device 110 determines metadata relating to the first song. As noted above, the metadata relating to the first song might include information from the first transition functions, the first database 140, the explicit user preferences, or other sources.

At a step 215, the computing device 110 concludes, from the metadata determined in the previous step, whether or not to cross-fade.

At a flow point 210B, if the computing device 110 concluded that the first song should be cross-faded, the method 210 proceeds with the method 230.

At a flow point 210C, if the computing device 110 concluded that the first song should not be cross-faded, an end of the method 210 is defined.

Cross-Fading II

FIG. 2B shows a process flow diagram of a method of determining whether to cross-fade in response to a first song and a second song.

A method 220 of determining whether to cross-fade in response to a first song includes flow points and steps shown in the figure, including at least the following:

| | |
|---|---|
| A flow point 220A, at which a beginning of the method 220 is defined. | A step 221, at which a first song is received. |
| A step 222, at which the first song is presented. | A step 223, at which an end of the first song is noted. |
| A step 224, at which the second song is noted. | A step 225, at which an interaction between the first song and the second song. |
| A step 226, at which it is concluded whether or not to cross-fade. | A flow point 220B, at which the method 220 continues to the method 230. |
| A flow point 220C, at which an end of the method 220 is defined. | |

At a flow point 220A, a beginning of the method 220 is defined.

At a step 221, a first song is received by the computing device 110.

At a step 222, the first song is presented to the user by the computing device 110.

At a step 223, an end of the first song is noted by the computing device 110. In a preferred embodiment, this step is performed substantially simultaneously with the previous step, and in any event, substantially before the end of the first song is required to be presented to the user. For example, determining whether to transition between the first song and the second song, and if so, how to make that transition, is preferably performed well in advance of having to calculate and present the audiovisual effects associated with that transition.

At a step 224, a beginning of the second song is noted by the computing device 110. In a preferred embodiment, similar to the previous step, this step is performed substantially simultaneously with the previous step, and in any event, substantially before the beginning of the second song is required to be presented to the user.

At a step 225, the computing device 110 notes an interaction between the first song and the second song. In a preferred embodiment, similar to the previous step, this step is performed substantially simultaneously with the previous step, and in any event, substantially before any transition between the first song and the second song is required to be presented to the user.

At a step 226, the computing device 110 concludes, from the interaction noted in the previous step, whether or not to cross-fade.

At a flow point 220B, if the computing device 110 concluded that the first song should be cross-faded, the method 220 proceeds with the method 230.

At a flow point 220C, if the computing device 110 concluded that the first song should not be cross-faded, an end of the method 220 is defined.

Cross-Fading III

FIG. 2C shows a process flow diagram of a method of performing cross-fading between a first song and a second song.

A method 230 of performing cross-fading includes flow points and steps shown in the figure, including at least the following:

| | |
|---|---|
| A flow point 230A, at which a beginning of the method 230 is defined. | A step 231, at which an end of the first song is received. |
| A step 232, at which a start of the second song is received. | A step 233, at which an end of the first song is noted. |
| A step 234, at which metadata is determined relating to how to cross-fade between the first song and the second song. | A step 235, at which it is concluded how to cross-fade between the first song and the second song. |
| A step 236, at which the cross-fade is performed. | A step 237, at which, after the cross-fade, the second song is performed. |
| A flow point 230B, at which an end of the method 230 is defined. | |

At a flow point 230A, a beginning of the method 230 is defined.

At a step 231, an end of the first song is received by the computing device 110.

At a step 232, a beginning of the second song is received by the computing device 110.

At a step 233, an end of the first song is noted by the computing device 110. In a preferred embodiment, this step is performed substantially simultaneously with the previous step, and in any event, substantially before the end of the first song is required to be presented to the user.

At a step 234, the computing device 110 determines metadata relating to how to transition between the first song and the second song. As noted above, the metadata relating to the transition between the first song and the second song might include information from the second transition functions, the second database 150, the deduced user preferences, or other sources.

At a step 235, the computing device 110 concludes, from the metadata noted in the previous step, how to perform the transition between the first song and the second song.

At a step 236, the computing device 110 performs the transition between the first song and the second song.

At a step 237, the transition between the first song and the second song, followed by the second song, are presented to the user by the computing device 110.

At a flow point 230B, an end of the method 230 is defined.

After reading this application, those skilled in the art will recognize that the steps in methods 210, 220, 230 for determining whether to transition and how to transition between songs can also be performed separately from the steps of presenting the songs. That is, the steps 212, 222 and 237 of presenting songs and transitions can be performed after the steps of computing the transition have already been performed, in addition to any other methods shown herein.

Methods of Operation II: Playlists

Figure 3A:
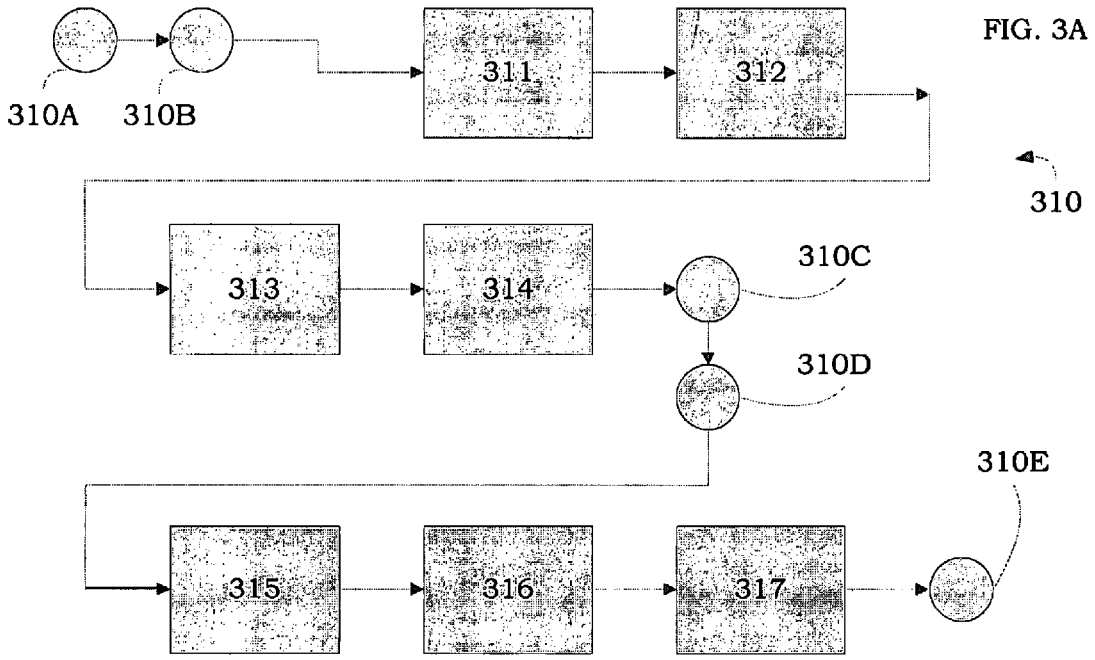
FIG. 3 (collectively including FIG. 3A and FIG. 3B) shows a set of process flow diagrams of methods relating to playlists, used with a system capable of constructing and presenting sound sequences.
Figure 3B:
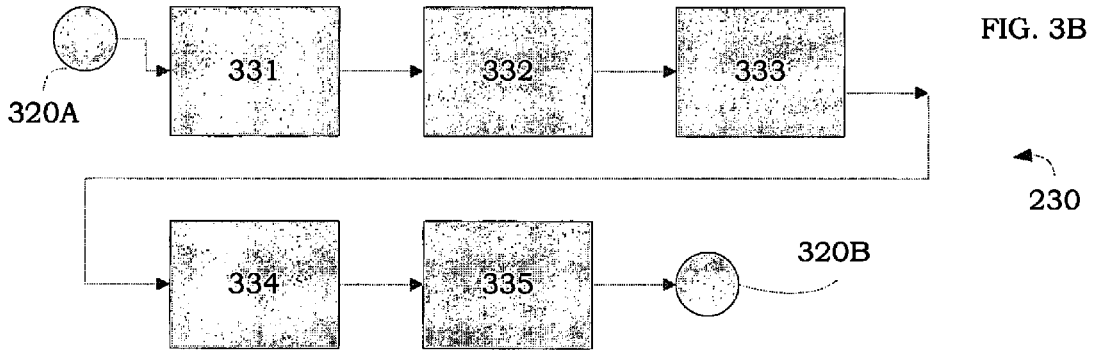

FIG. 3 (collectively including FIG. 3A and FIG. 3B) shows a set of process flow diagrams of methods relating to playlists, used with a system capable of constructing and presenting songs.

Playlists I

FIG. 3A shows a process flow diagram of a method of constructing a playlist.

A method 310 of constructing a playlist includes flow points and steps shown in the figure, including at least the following:

| | |
|---|---|
| A flow point 310A, at which the method 310 begins. | A flow point 310B, defining a beginning of a first procedure (to select songs). |
| A step 311, at which the $n^{th}$ song to be selected is set to the first song. | A step 312, at which a song to fit "next" into the playlist is selected. |
| A step 313, at which the $n^{th}$ song is selected. | A step 314, at which it is determined if there are "enough" songs in the playlist. |
| A flow point 310C, defining an end of the first procedure (to select songs). | A flow point 310D, defining a beginning of a second procedure (to optimize the playlist). |
| A step 315, at which the most recently constructed playlist is evaluated. | A step 316, at which an attempt is made to optimize among all playlists constructed so far. |
| A step 317, at which it is determined if "enough" optimizing has been performed. | A flow point 310E, defining an end of the second procedure (to optimize the playlist). |
| A flow point 310F, at which the method 310 ends. | |

At a flow point 310A, a beginning of the method 310 is defined.

At a flow point 310 B, a beginning of a first procedure (to select songs) is defined. The computing device 110 performs the steps from this flow point to the flow point 310C repeatedly until it selects a complete playlist, including "enough" songs.

At a step 311, the computing device 110 selects a first song from a set of possible songs for the playlist, and assigns that first song as the next song to be selected.

In a preferred embodiment, the set of possible songs for the playlist might include all songs available to the computing device 110, such as any one of (1) all songs owned by the user, (2) all songs owned by the user or for which the user has given authority to purchase, or (3) all songs for which the user does not own but has authority to play, such as for example in a streaming format, or for which the user has given authority to purchase the right to play, such as for example a once-only license to play that song.

In alternative embodiments, the user might inform the computing device 110 of a preferred type of songs for the playlist to be selected, such as for example, songs by a particular author or singer, songs in a particular genre or time period, songs having a particular emotional affect, songs having a particular range of lengths, and the like.

At a step 312, the computing device 110 selects a song to best fit next in the playlist. In selecting a best fit song, the computing device 110 considers one or more of, or some combination of, the following factors:

A weighted value associated with a smoothness of the transition between the current song and the next song. For example, with varying degrees of importance, it might be desirable to select songs for the playlist, and to order the selection of those songs, that have relatively smooth transitions.

A weighted value associated with a degree of the match between the current song and the next song. For example, with varying degrees of importance, it might be desirable to select songs for the playlist that are within the same emotional affect, the same genre, the same particular groups or singers, the same particular instruments, and the like.

A weighted value associated with a degree of change between the current song and the next song. For example, with varying degrees of importance, it might be desirable to order the selection of songs for the playlist so that upbeat songs are followed by downbeat songs, and vice versa, or fast-paced songs are followed by slow-paced songs, and vice versa, and the like.

After reading this application, those skilled in art will recognize that the use of weighted values allows the system to place more or less emphasis, as desired by the user either explicitly or implicitly, on particular aspects of forming playlists. The particular weighted values listed herein are intended to be exemplary only, and are not intended to be exhaustive or limiting in any way.

For just one example, playlists (and the transitions between songs upon which they depend) might be constructed by reference to external databases of expert information. These might be included in, or supplement, the information available in the first database 140 and the second database 150. In a preferred embodiment, construction of a playlist should best attempt to optimize a number of factors, including desirability of the songs to the user, availability of the songs in an ordering that is pleasing and perceptually random, and smoothness of transitions between those songs. These particular factors listed herein are intended to be exemplary only, and are not intended to be exhaustive or limiting in any way.

At a step 313, the computing device 110 selects the next song for the playlist.

At a step 314, the computing device 110 determines if there are enough songs for the playlist. In making this determination, the computing device 110 considers one or more of, or some combination of, the following factors:

A weighted value associated with a number of songs in the playlist, in particular, whether that number is too few or too many. Too few songs might make for a relatively uninteresting playlist, while too many songs might make for a relatively confusing playlist.

A weighted value associated with a presentation length of the playlist, in particular, whether that presentation length is too short or too long. Similar to the number of songs, too short a playlist might make for a relatively uninteresting playlist, while too long a playlist might make for a relatively confusing playlist.

At a flow point 310C, an end to the first procedure (to select songs) is defined.

At a flow point 310D, a beginning of a second procedure (to optimize the playlist) is defined.

At a step 315, the computing device 110 evaluates the most recently constructed playlist.

At a step 316, the computing device 110 attempts to optimize the playlist among all playlists constructed so far. To perform optimization, the computing device 110 might use one or more of, or some combination of, the following optimization techniques:

The computing device 110 might generate a predetermined number of playlists and select the best.

The computing device 110 might conduct a pseudorandom search procedure, in which the computing device 110 generates and improves playlists until they are no longer easy to improve. Examples of such techniques include simulated annealing and genetic programming.

The computing device 110 might enlist the assistance of the user, in which the computing device 110 generates playlists and requests input from the user regarding their relative improvement, until they are no longer easy to improve.

At a step 317, the computing device 110 determines if enough optimizing has been performed. The type of operation to perform this step depends, as described in the previous step, on the type of optimizing technique the computing device 110 uses.

At a flow point 310E, an end of the second procedure (to optimize the playlist) is defined.

At a flow point 310F, an end of the method 310 is defined.

Playlists II

FIG. 3B shows a process flow diagram of a method of purchasing songs using playlists.

A method 320 of purchasing songs using playlists includes flow points and steps shown in the figure, including at least the following:

| | |
|---|---|
| A flow point 320A, at which the method 320 begins. | A step 321, at which a description of a set of playlists is presented to a user. |
| A step 322, at which input from the user regarding selection of a playlist is received. | A step 323, at which a description of the selected playlist is presented to the user. |
| A step 324, at which input from the user regarding which songs to purchase is received. | A step 325, at which a commercial transaction to purchase those songs is performed. |
| A flow point 320B, at which the method 320 ends. | |

At a flow point 320A, a beginning of the method 320 is defined.

At a step 321, the computing device 110 presents a description of a set of playlists to the user. In a preferred embodiment, the computing device 110 uses a user interface similar to the "Mosaic" user interface described in the incorporated disclosure, with the enhancement provided of graying out those songs to which the user has limited (or perhaps no) rights.

At a step 322, the computing device 110 receives input from the user, selecting a playlist to review.

At a step 323, the computing device 110 presents a description of the selected playlist to the user. For example, the computing device 110 might list the songs in the playlist, or might present a set of pictorial representations of those songs for the user to peruse.

At a step 324, the computing device 110 receives input from the user, selecting a playlist to purchase.

At a step 325, the computing device 110 conducts a commercial transaction, on behalf of the user, with an external license server. This has the effect that the user obtains new rights to the purchased playlist. In a preferred embodiment, the computing device 110 purchases only those songs in the playlist (or set of playlists) needed for the user to complete the selected playlists. Also in a preferred embodiment, the computing device 110 already has the selected playlists speculatively downloaded from the external license server, needing only a license key to provide the user with the ability to present those playlists (or the songs therein).

Generality of the Invention

This invention should be read in the most general possible form. This includes, without limitation, the following possibilities included within the scope of, or enabled by, the invention.

After reading this application, those skilled in the art would recognize that the decision to perform transitions between two songs is not restricted to information about those two songs only. For a given song in a playlist, when the system is deciding whether to perform a transition and how to perform a transition at that song, the system may refer to the information about all the songs in the playlist, not just the previous song or next song. The system may refer to any ordered n-tuple or any collection of songs within the playlist (whether sequential or not) while making its decisions about transitions for a given song. For example, if a playlist includes a particular song, then the presence of that song may influence the decision to perform a transition between a completely different consecutive pair of songs in the playlist. For example, the two external databases, 140 and 150, and the two transition functions, 113 and 117, may refer to arbitrary n-tuples of songs or arbitrary sequences of songs, not only pairs of songs.

Similarly, after reading this application, those skilled in the art would recognize that the construction of playlists does not depend on pairs of songs only. At step 312 when the system is finding a next song to add to a partially constructed playlist, the system may refer to all the songs in the partially constructed playlist, not only the previous song. At the optimization steps 316 and 317 it is clear that the system is evaluating collections of songs, not only pairs of songs. For example, the system may consider the smoothness of the transitions between some or all pairs of songs in the playlist, not only the pair under evaluation in any step of method 310.

After reading this application, those skilled in the art would see the generality of this application.

The invention claimed is:

1. A method, comprising:

determining a first song and a second song, for which a transition is possible between that first song and that second song;

determining, with reference to a first genre relating to said first song and a second genre relating to said second song, whether to perform a transition function between those songs; and determining, in response to a second set of data, including information relating to one or more possible transitions, a selectable particular transition to be performed between those songs.

2. A method as in claim 1, including steps of generating a presentable sequence, including at least a portion of each of those songs, and that selectable particular transition.

3. A method as in claim 1, including steps of in response to information regarding a particular first song being followed by a particular second song, steps of presenting that particular first song, that particular second song, and a transition in between.

4. A method as in claim 1, wherein at least some of those possible transitions include audio effects; and at least some of those possible transitions include visual effects.

5. A method as in claim 1, wherein a set of metadata about said songs is responsive to one or more of: a set of acoustic properties; a set of album and box set information; a set of eras; a set of genres; a set of moods; a set of instrumentation; a set of singers; a set of track numbering; and a set of writers.

6. A method, comprising:

receiving at least a portion of a first song, for which one or more transitions are possible to at least a portion of a second song;

obtaining metadata comprising a first genre associated with said first song and a second genre associated with said second song; and concluding whether or not to perform a transition between said first song and said second song with reference to said first genre and said second genre.

7. A method as in claim 6, including steps of presenting that first song.

8. A method as in claim 6, including steps of receiving at least a portion of said second song, for which one or more transitions are possible from at least a portion of that first song; and determining an interaction between that first song and that second song.

9. A method as in claim 8, including steps of in response to a result of those steps of determining an interaction, determining a particular transition applicable to that first song and that second song; performing that particular transition; and presenting at least a portion of that first song and that second song in response to that transition.

10. A method as in claim 8, wherein those steps of determining an interaction include steps of accessing a first set of data associated with transitions applicable to that first song and that second song, and accessing a second set of data associated with a set of user preferences.

11. A method as in claim 8, wherein those steps of determining an interaction include steps of determining whether to apply a transition between that first song and that second song.

12. A method as in claim 6, wherein at least two of those steps of receiving, determining, and concluding are performed concurrently.

13. A method as in claim 6, wherein at least one of those steps of receiving, determining, and concluding is performed in real time with presenting at least one of that first song and that second song.

14. A method as in claim 6, wherein a set of metadata about said songs is responsive to one or more of: a set of acoustic properties; a set of album and box set information; a set of eras; a set of genres; a set of moods; a set of instrumentation; a set of singers; a set of track numbering; and a set of writers.

15. A method as in claim 6, wherein those steps of determining at least some metadata include steps of accessing a first set of data associated with that first song, and accessing a second set of data associated with a set of user preferences.

16. The method of claim 6, wherein said concluding comprises concluding whether or not to apply a particular transition between said first song and said second song.

17. Apparatus, comprising:

means for determining a first song and a second song, for which a transition is possible between that first song and that second song;

means for determining, with reference to information indicating a first artist relating to said first song and a second artist relating to said second song, whether to perform a transition function between those songs; and means for determining, in response to a second set of data, including information relating to one or more possible transitions, a selectable particular transition to be performed between those songs.

18. Apparatus as in claim 17, including means for generating a presentable sequence, including at least a portion of each of those songs, and that selectable particular transition.

19. Apparatus as in claim 17, including means for presenting that particular first song, that particular second song, and a transition in between, in response to information regarding a particular first song being followed by a particular second song.

20. Apparatus as in claim 17, wherein at least some of those possible transitions include audio effects; and at least some of those possible transitions include visual effects.

21. Apparatus as in claim 17, wherein a set of metadata about said songs is responsive to one or more of: a set of acoustic properties; a set of album and box set information; a set of eras; a set of genres; a set of moods; a set of instrumentation; a set of singers; a set of track numbering; and a set of writers.

22. Apparatus, including means for receiving at least a portion of a first song, for which one or more transitions are possible to at least a portion of a second song;

means for obtaining metadata comprising a first artist associated with said first song and a second artist associated with said second song; and means for concluding whether or not to a transition between said first song and said second song with reference to said first artist and said second artist.

23. Apparatus as in claim 22, including means for presenting that first song.

24. Apparatus as in claim 22, including means for receiving at least a portion of said second song, for which one or more transitions are possible from at least a portion of that first song; and means for determining an interaction between that first song and that second song.

25. Apparatus as in claim 24, including means for determining a particular transition applicable to that first song and that second song, in response to those means for determining an interaction;

means for performing that particular transition; and means for presenting at least a portion of that first song and that second song in response to that transition.

26. Apparatus as in claim 24, wherein those means for determining an interaction include means for accessing a first set of data associated with transitions applicable to that first song and that second song, and means for accessing a second set of data associated with a set of user preferences.

27. Apparatus as in claim 24, wherein those means for determining an interaction include means for determining whether to apply a transition between that first song and that second song.

28. Apparatus as in claim 22, wherein at least two of those means for receiving, determining, and concluding operate concurrently.

29. Apparatus as in claim 22, wherein at least one of those means for receiving, determining, and concluding operates in real time with means for presenting at least one of that first song and that second song.

30. Apparatus as in claim 22, wherein a set of metadata about those songs is responsive to one or more of: a set of acoustic properties; a set of album and box set information; a set of eras; a set of genres; a set of moods; a set of instrumentation; a set of singers; a set of track numbering; and a set of writers.

31. Apparatus as in claim 22, wherein those means for determining at least some metadata include means for accessing a first set of data associated with that first song, and means for accessing a second set of data associated with a set of user preferences.

32. The apparatus of claim 22, wherein said means for concluding is for concluding whether or not to apply a particular transition between said first song and said second song.

33. A computer-readable medium having computer-executable instructions for performing a method comprising:

determining a first song and a second song, for which a transition is possible between that first song and that second song;

determining, with reference to information indicating whether said first song and said second song appear on the same medium, whether to perform a transition function between those songs; and determining, in response to a second set of data, including information relating to one or more possible transitions, a selectable particular transition to be performed between those songs.

34. The computer-readable medium of claim 33, further comprising:

generating a presentable sequence, including at least a portion of each of said songs, and said selectable particular transition.

35. The computer-readable medium of claim 33, further comprising:

presenting said first song, said second song, and a transition in between, in response to information regarding a particular first song being followed by a particular second song.

36. The computer-readable medium of claim 33, wherein at least some of those possible transitions include audio effects; and at least some of those possible transitions include visual effects.

37. The computer-readable medium of claim 33, wherein a set of metadata about those songs is responsive to one or more of: a set of acoustic properties; a set of album and box set information; a set of eras; a set of genres; a set of moods; a set of instrumentation; a set of singers; a set of track numbering; and a set of writers.

38. Apparatus, including a digital medium including at least a portion of a first song, for which one or more transition functions can be applied to at least a portion of a second song;

user preference data;

metadata associated with that first song, said metadata comprising a song name relating to said first song; and a first function relating to one or more of those songs, that first function indicating whether to perform a transition function to that first song in response to said song name and said user preference data.

39. Apparatus as in claim 38, further comprising:

a digital medium including at least a portion of a second song, for which one or more transition functions are possible from at least a portion of said first song; and a particular transition function to be performed between said first song and said second song.

40. Apparatus as in claim 38, further comprising:

a particular transition function to be performed between said first song and said second song; and a digital medium including a result of performing said particular transition function.

41. Apparatus as in claim 38, further comprising:

a set of metadata about said songs, responsive to one or more of: a set of acoustic properties; a set of album and box set information; a set of eras; a set of genres; a set of moods; a set of instrumentation; a set of singers; a set of track numbering; and a set of writers.

* * * * *